US005687688A

United States Patent [19]

Tsunoda et al.

[11] Patent Number: 5,687,688

[45] Date of Patent: Nov. 18, 1997

[54] VERTICAL ENGINE

[75] Inventors: Masaki Tsunoda; Tetsu Wada; Yoshimi Watanabe; Hiroyuki Yoshida, all of Wako, Japan

[73] Assignee: Honda Giken Kogyo Kabushiki Kaisha, Tokyo, Japan

[21] Appl. No.: 534,969

[22] Filed: Sep. 28, 1995

[30] Foreign Application Priority Data

| | | | |
|---|---|---|---|
| Oct. 3, 1994 | [JP] | Japan | 6-263195 |
| Oct. 3, 1994 | [JP] | Japan | 6-263196 |
| Oct. 3, 1994 | [JP] | Japan | 6-263197 |

[51] Int. Cl.[6] ..... F01M 11/02

[52] U.S. Cl. ..... 123/196 W; 184/6.18

[58] Field of Search ..... 123/196 W; 184/6.18

[56] References Cited

U.S. PATENT DOCUMENTS

| | | | |
|---|---|---|---|
| 2,357,942 | 9/1944 | Farr et al. . | |
| 4,562,797 | 1/1986 | Suzuki . | |
| 4,802,871 | 2/1989 | Watanabe et al. . | |
| 5,090,375 | 2/1992 | Hudson | 184/6.18 |
| 5,456,230 | 10/1995 | Van Rens et al. | 123/196 W |
| 5,524,581 | 6/1996 | Rush, II et al. | 123/196 W |

FOREIGN PATENT DOCUMENTS

| | | | |
|---|---|---|---|
| 3-21509 | 3/1991 | Japan . | |
| 3-23609 | 3/1991 | Japan . | |
| 6323118 | 11/1994 | Japan | 123/196 W |
| 328490 | 5/1930 | United Kingdom | 184/6.18 |

*Primary Examiner*—Erick R. Solis

*Attorney, Agent, or Firm*—Armstrong, Westerman, Hattori, McLeland & Naughton

[57] ABSTRACT

In a vertical engine having a crankshaft directed in a vertical direction and a flywheel provided on a lower end of the crankshaft projected through a bottom wall of a crank chamber, the crank chamber is formed by a skirt section integral with a cylinder block and a split crankcase attached to the skirt section putting respective contacting faces together and an oil dropping hole is formed in a bearing wall section provided on the cylinder block side and forming a lowest crank bearing section within the crank chamber. The oil dropping hole communicates with an lower side of the bearing wall section and an upper side of the bearing wall section positioned within a lowest cylinder and is inclined downward from the cylinder side to the contacting face of the skirt section facing to the split crankcase. A flywheel space is formed under the bottom wall of the crank chamber and an oil pan is provided under the flywheel space. An oil return passage extending from the crank chamber to the oil pan detours around the flywheel space.

8 Claims, 8 Drawing Sheets

VERTICAL ENGINE

BACKGROUND OF THE INVENTION

The present invention relates to a vertical engine with a crankshaft directed vertically.

A vertical engine (upright-type engine) having a crankshaft directed vertically is disclosed in Japanese Laid-Open Utility Model Publication No. Hei 3-21509 and Japanese Laid-Open Utility Model Publication No. Hei 3-23609, for example. In this engine, a flywheel is provided on a lower end of a crankshaft projected from an engine main body.

The above-mentioned flywheel is received in a flywheel space, below which a transmission housing is formed continuously for receiving engine lubricating oil. The interiors of the transmission housing and the engine main body are communicated with each other by means of a feed pipe and a return pipe detouring around the outside of the flywheel space so that the lubricating oil does not intrude into the flywheel space. The oil within the transmission housing is fed to an oil pump positioned at an upper portion of a crank chamber through the feed pipe and return oil is returned into the transmission housing from a oil reservoir formed in a neighborhood of an lower end portion of a crank cover through the return pipe.

This engine has a cylinder block in which a plurality of cylinders are arranged in a line vertically and close to each other.

In such a cylinder block, a thickness (width) of a crank bearing section formed on an extension of a wall between the cylinders is larger than that of the wall between the cylinders, and therefore, the oil to be scraped off into the crank chamber by a sliding piston is apt to remain on a wall surface near the crank bearing section.

Accordingly, hitherto, drilling work was carried out from below the cylinder block to form an oil return hole at each inter-cylinder wall communicating with upper and lower cylinders. However, in the engine having the flywheel provided on the lower end of the crankshaft, as described above, the above-mentioned drilling work from below cannot be carried out to form the oil return holes because the flywheel space is directly below the cylinder block, and a construction without such oil return holes is required. Therefore, it is difficult to ensure a smooth oil circulation.

As the above customary vertical engine is provided with a transmission housing having input, and output shafts coaxial with the crankshaft under the flywheel space, when the engine is mounted on an industrial machine, taking out of the engine output and supporting of the engine must be carried out so as not to interfere with the transmission housing. Therefore, the engine is very inconvenient.

For example, in an outboard motor a driving shaft is arranged within an outboard motor body case at a position near the boat and the engine is mounted with the crankshaft positioned above the driving shaft. Therefore, if it is intended to mount the customary vertical engine on the outboard motor, some devices for housing all parts, including the transmission housing, within an engine space are necessary, and the height of the resultant outboard motor becomes very high. Moreover parts rotating about a tilt axis and moment arm about the tilt axis are increased, so that the outboard motor becomes still larger.

In the above customary vertical engine, since the oil circulating path between the transmission housing having an oil pan and the engine body is formed by the feed pipe and the return pipe going around a side of the flywheel space opposite to the cylinder head, the oil path is lengthened and it is feared that a smooth oil return is obstructed.

Further, in the above customary vertical engine, the oil within the engine body is returned to the transmission housing through the return pipe from the oil reservoir which is formed in the vicinity of a lower end of a trunk cover and has only a flat bottom part. Therefore, it is feared that the oil return is not smooth.

Since the return pipe is connected to the oil reservoir at its lower end of the side opposite to the cylinder head and extends downward on the same side passing by the flywheel space to be connected to the transmission housing directly, when the cylinder head side is lowered owing to an inclination of an outboard motor mounted with the engine, for example, the oil returning- within the crank chamber is deteriorated. An inclination of the outboard motor occurs in such cases so that the boat accelerates or runs without carrying out a trim adjustment about a tilt shaft, for example.

SUMMARY OF THE INVENTION

The present invention is accomplished in view of the foregoing circumstances. According to the present invention, there is provided a vertical engine having a crankshaft directed in a vertical direction and a flywheel provided on a lower end of the crankshaft projected through a bottom wall of a crank chamber, comprising a flywheel compartment formed under said bottom wall of the crank chamber for housing said flywheel, an oil pan provided under said flywheel compartment and reserving containing oil lubricating said crankshaft, at least a part of said oil pan being positioned at a side opposite to said crank chamber with respect to said flywheel compartment, and an oil return passage for returning said oil from said crank chamber to said oil pan detouring around said flywheel compartment.

In this invention, the return oil within the crank chamber positioned above the flywheel compartment is guided by the oil return passage and flows smoothly down into the oil pan provided under the flywheel compartment. As at least a part of the oil pan is positioned at a side opposite to the crank chamber with respect to the flywheel compartment, an oil supply passage to a cylinder head side of the engine body and an oil return passage from the cylinder head side can be formed easily at a place kept away from the flywheel room above the oil pan.

The oil return passage from the crank chamber is provided on the bottom wall of the crank chamber so as to extend toward the cylinder head side penetrating a wall portion continuing to the bottom wall and reaching a position beyond an outer peripheral portion of the flywheel. Thus, it is possible to form an oil circulating passage, within the engine, detouring around the flywheel space between the oil pan and the engine body for ensuring a smooth oil return and making the whole engine compact to facilitate mounting of the engine on an outboard motor. Also the outboard motor provided with such an engine is made compact and its attaching and supporting to a boat body by the tilt shaft is facilitated.

In a vertical engine according to the present invention, the oil return passage is constituted by a first vertical passage portion positioned lower than the flywheel and communicating with the oil pan, and a second passage portion extending along an outer peripheral part of the flywheel and inclined downward toward the first passage portion.

In this vertical engine, since the oil in the crank chamber is returned to the oil pan through the oil return passage formed along the outer peripheral part of the flywheel, an external return pipe to connect the crank chamber to the oil pan is unnecessary and the engine can be made compact.

In addition, since the oil return passage is constituted by the second passage portion which extends along an outer peripheral part of the flywheel inclining downward from the crank chamber side and reaches a lowermost position under the flywheel and above the oil pan, and the first passage portion which extends vertically downward from the lowermost position of the second passage portion to the oil pan, the oil smoothly flows down through the oil return passage from the upper crank chamber to the lower oil pan detouring around the flywheel and, even if the engine is inclined, oil return is not deteriorated.

A vertical engine according to the present invention comprises a skirt section provided integrally with a cylinder block, a split crankcase attached to said skirt section by putting respective contacting faces together to form said crank chamber, a bearing wall section provided on said cylinder block side and forming a lowest crank bearing section within said crank chamber, and an oil-dropping hole provided in said bearing wall section and communicating with a lower side of said bearing wall section and an upper side of said bearing wall section positioned within a lowest cylinder, said oil dropping hole being inclined downward from said cylinder side to said contacting face of said skirt section facing to said split crankcase.

The above mentioned oil dropping hole can be formed without drilling the bottom wall of the crank chamber by directing a drilling tool obliquely upward to the skirt section of the cylinder block from the opened contacting face side.

The oil dropping hole is formed in the bearing wall section of the cylinder block side and communicates with the above mentioned portion within the cylinder where the oil is apt to remain so that the oil in the cylinder is returned well into the crank chamber through the oil-dropping hole, moreover, the returned oil does not intrude into the flywheel space under the bottom wall portion of the crank chamber and a smooth circulation is ensured.

In a case that the engine is an in-line, multi-cylinder engine having a plurality of cylinders arranged vertically, each cylinder wall portion partitioning adjacent upper and lower cylinders is provided an oil hole at an end on the crank chamber side. The oil hole is formed so as to be inclined downward from the interior of the cylinder wall portion to the crank chamber by being drilled obliquely upward from the side of the contacting face to the split crankcase.

These oil holes can be formed independently and easily in the same manner as the oil-dropping hole. The oil in the cylinder flows down through these oil holes in order and discharges between the bearing wall section and the crank chamber bottom wall through the oil-dropping hole at the lowest position.

In the case that an oil passage guiding oil from the oil-dropping hole to a cylinder head side is provided in the crank chamber bottom wall portion and the oil drops into a lower oil pan at the cylinder head side through the oil passage, it is unnecessary to send the oil returned from the cylinder once to an oil reservoir at the side opposite to the cylinder of the crank chamber in a manner of going over the flywheel as in the ease of the aforementioned prior art. Instead, it is possible to return the oil through a shorter returning passage. Accordingly, the oil flows smoothly and required total oil volume can be reduced.

DETAILED DESCRIPTION OF THE PREFERRED EMBODIMENT

Hereinafter, a preferred embodiment in which the present invention is applied to a vertical engine for an outboard motor will be described.

Figure 1:
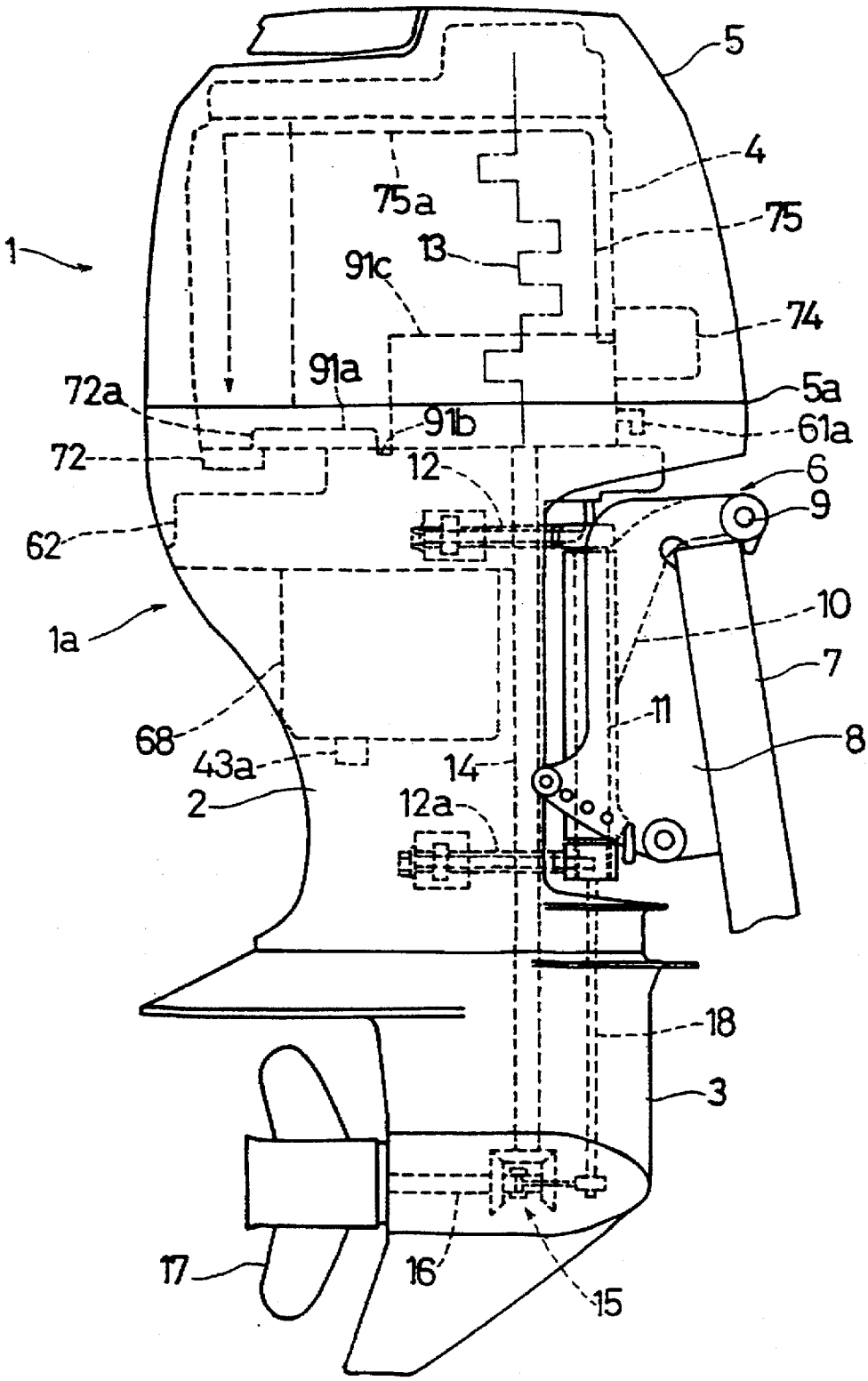
FIG. 1 is a side view of an entire outboard motor mounted with a vertical engine according to the present invention.

FIG. 1 is a side view of an entire outboard motor 1 provided with a vertical engine according to the present invention. On an outboard motor main body la comprising an extension case 2, gear case 3, etc. is mounted an engine 4 according to the present invention. The engine 4 is covered by an engine cover 5 from above.

The outboard motor 1 is attached to a stern 7 by means of an attaching device 6. The attaching device 6 has a bracket 8 fixed to the stern 7 by bolts and a swivel case 10 pivoted to the bracket 8 rockably up and down by means of a tilt shaft 9 laterally supported at a front end of the bracket 8. A swivel shaft 11 directed up and down is pivoted to the swivel case 10 rotabaly. The outboard motor 1 is connected to the swivel shaft by means of upper and lower connecting members 12, 12*a*.

A crankshaft 13 of the engine 4 is directed vertically (in an up-and-down direction) and a driving shaft 14 connected to the crankshaft 13 extends in the extension case 2 downward and reaches within the gear case 3. A lower end of the driving shaft 14 is connected to a propeller shaft 16 through an ahead-astern changing device 15 in the gear case 3 and a propeller 17 is rotationally driven by engine power transmitted through the crankshaft 13, the driving shaft 14, ahead-astern changing device 15 and propeller shaft 16.

Figure 2:
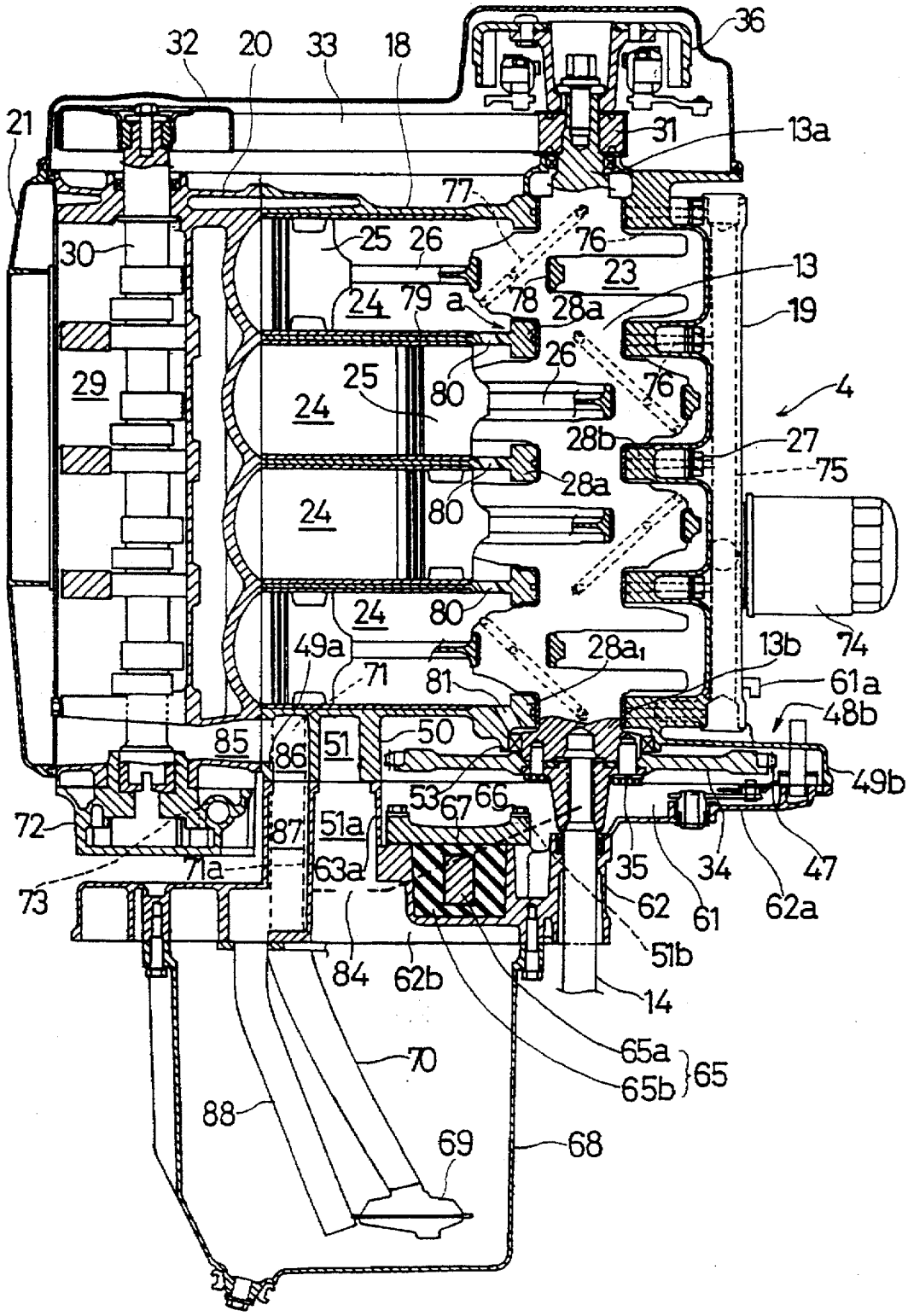
FIG. 2 is a longitudinal side sectional view.
Figure 3:
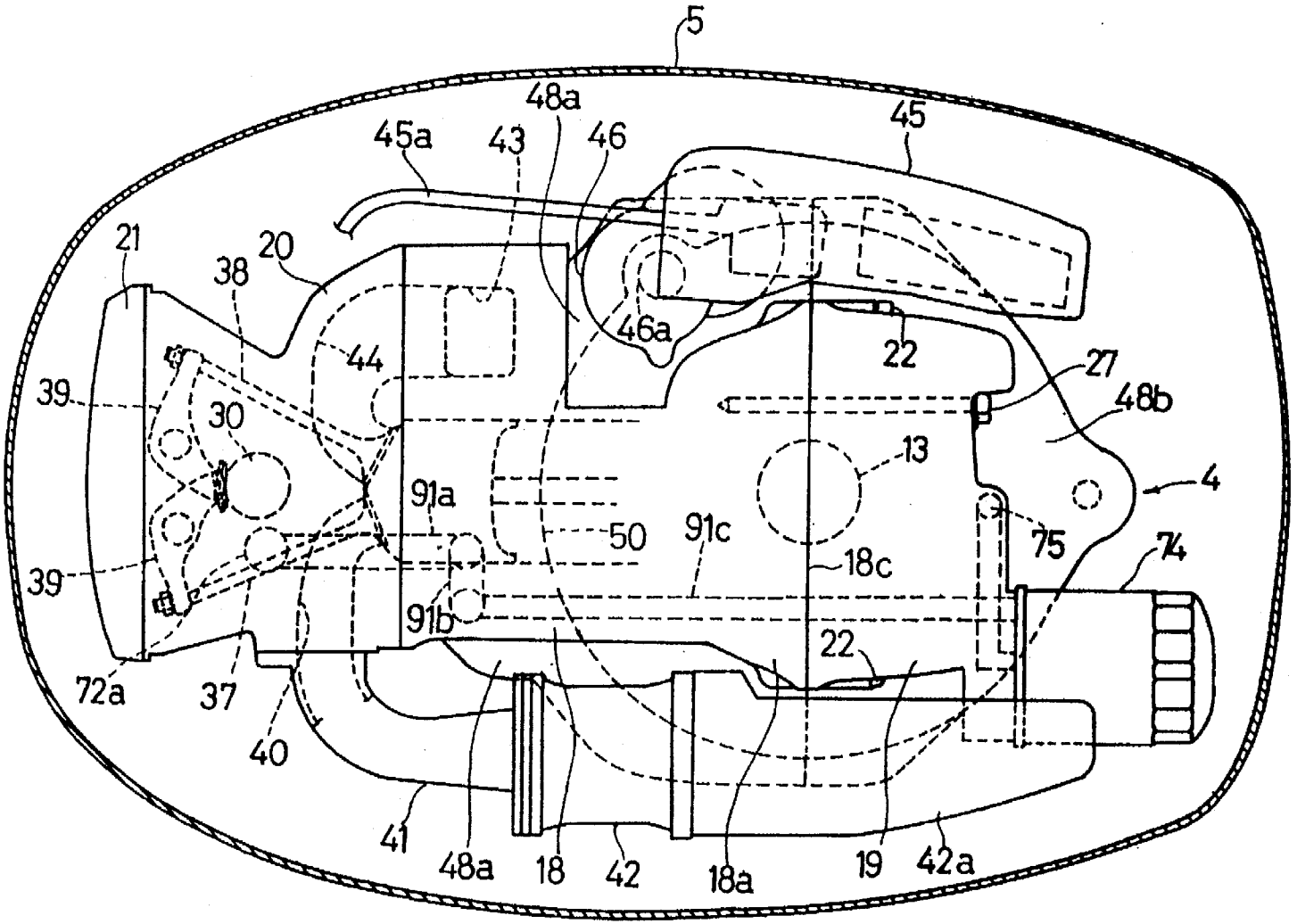
FIG. 3 is a general schematic plan view showing the engine in an engine cover together with auxiliary instruments.

FIG. 2 is a longitudinal sectional view of the engine 4 and FIG. 3 is a rough plan view showing the engine 4 in the engine cover 5 together with auxiliary instruments thereof.

As mentioned above, the crankshaft is directed vertically. The engine 4 is mounted in the state that the crankshaft 13 is positioned in a front (ship side) portion of the outboard motor and the cylinder head in a rear portion, as shown in FIG. 1. That is, the right side in FIGS. 2 and 3 corresponds to the front side of the outboard motor 1.

The main body portion of the engine 4 is constituted by a cylinder block 18 having integrally a skirt section 18*a* forming a half part of a crankcase, a split crankcase 19 forming a remaining half part of the crankcase, a cylinder head 20 and a cylinder head cover 21. A contacting face of the split crankcase 19 and a contacting face of the skirt section 18*a* are abutted to each other and the split crankcase 19 and the skirt section 18*a* are integrally connected to each other by bolts 22 to form a crank chamber 23 within the main body portion.

Four cylinders 24 are arranged in a line vertically within the cylinder block 18. Namely, the engine 4 is an in-line 4-cylinder 4-cycle engine in which each piston 25 is connected to a common vertical crankshaft 13 by separate connecting rods. The crankshaft 13 is rotatably supported within the crank chamber 23, being pinched between bearing sections 28*a*, 28*b* provided on the cylinder block 18 side and the split crankcase 19 side, respectively, oppositely to each other and fastened by bolts 27.

A cam shaft 30 is arranged vertically in a valve gear chamber 29 formed in the cylinder head 20. The cam shaft 30 is driven by the crank shaft 13 through a belt transmission device which comprises a drive pulley 31 installed at an upper end 13*a* of the crankshaft 13 projected from the crank chamber 23, driven pulley 32 installed at an upper end of the cam shaft 30 projected from the cylinder head 20 and a belt 33 wound around the both pulleys 31, 32. At the upper end 13*a* of the crank shaft 13 is installed further a generator 36 above the drive pulley 31.

At a lower end 13*b* of the crankshaft 13 projected to penetrate a bottom wall of the crank chamber 23 is connected the abovementioned driving shaft 14. Further, a disk-like flywheel 34 is connected to the lower end 13*b* by screws 35 extending parallel with an undersurface of the engine main body portion. Due to providing the flywheel at the connecting portion between the lower end of the crankshaft and the driving shaft in this manner, twist vibration of the engine is reduced.

As shown in FIG. 3, a valve mechanism comprising a suction valve 37, an exhaust valve 38, rocker arms 39, 39 etc. is provided at every cylinder 24 to be controlled by the cam shaft 30. The cylinder head 20 is provided with an intake passage 40, and an intake manifold 41 connected to the intake passage 40 extends forward along a side surface of the engine 4. Numeral 42 denotes one of four carburetors and 42*a* denotes a suction silencer box. The intake manifolds 41 for all cylinders 25 are arranged in parallel and up and down with respect to each other along the side surface of the engine 4.

On the other side of the engine 4 extends vertically an exhaust passage 43 with which exhaust passages 44 for the cylinders 24 communicate. The exhaust passage 43 is connected to an upper end of an exhaust pipe 43*a* extending vertically in the extension case 2 (FIG. 1). The exhaust passes through the exhaust pipe to be discharged into water from a lower end of the pipe through a boss portion of the propeller, for example.

On the same side of the engine 4 as the exhaust passage 43 is arranged an electric box 45 containing electric parts, such as a CPU, ignition coils, or the like. In front and underneath thereof is arranged a starter motor 46. Reference numeral 45*a* indicates an ignition plug cord connected to ignition plugs on a side surface of the cylinder head 20. An output shaft 46*a* of the starter motor 46 projects downward and engages with a ring gear 47 (FIG. 2) formed on a periphery of the flywheel 34.

Figure 4:
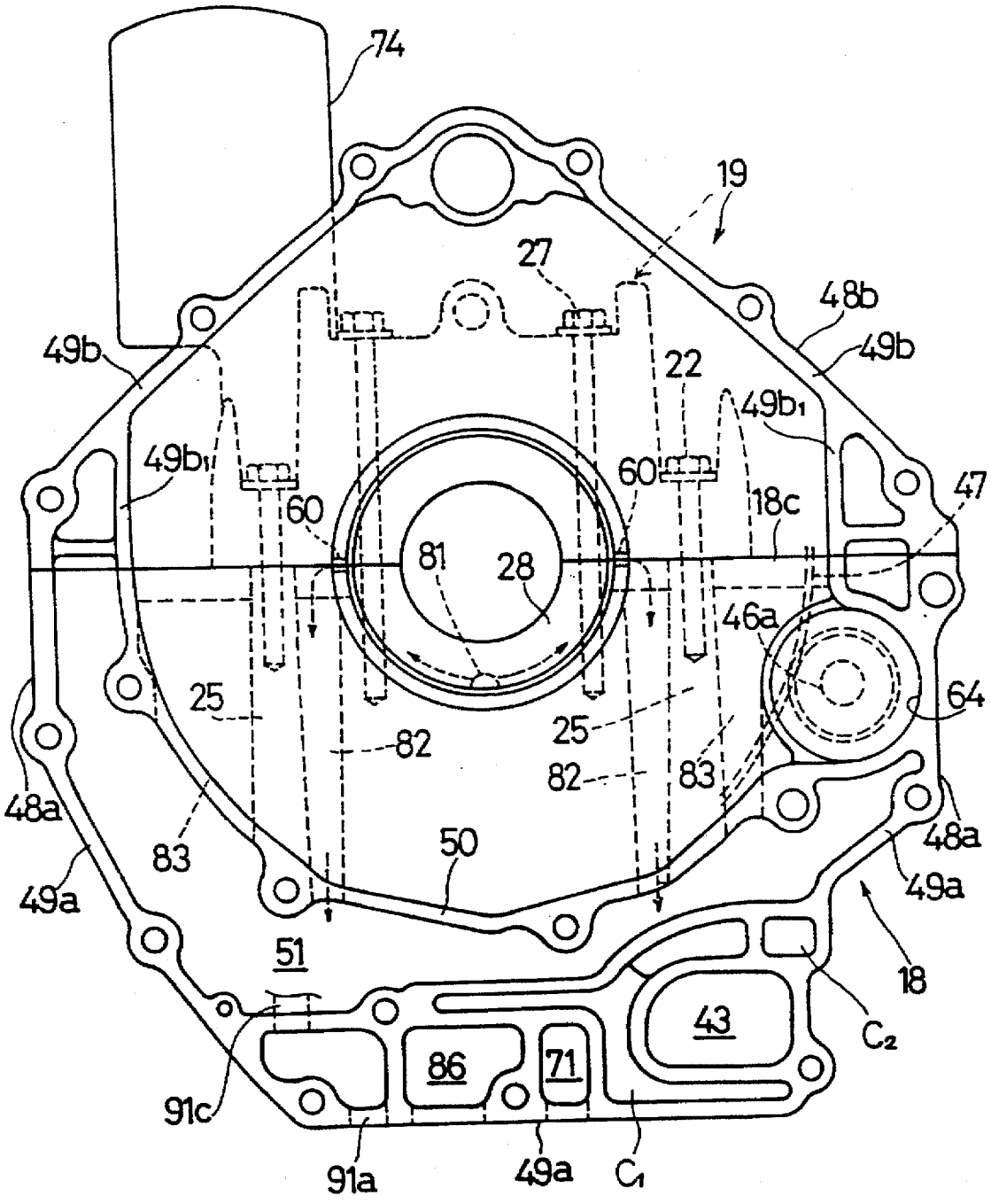
FIG. 4 is a lower view of the engine main block composed of the cylinder block and the split crankcase connected thereto.

FIG. 4 is a lower view of the engine main block composed of the cylinder block 18 and the split crankcase 19 connected thereto. As obvious from FIG. 4 and the abovementioned FIGS. 2 and 3, the lower portion of the cylindrical block 18 is formed with a swelled part 48*a* projecting to both sides of the engine (to right and left direction of the outboard motor) in parallel with the plane of rotation of the flywheel, and the lower portion of the split crankcase 19 is also formed with a swelled part 48*b* projecting to the right and left and the side opposite to the cylinder head (with frontward respect to the outboard motor). Along outer peripheral edges of the swelled part 48*a*, 48*b* are formed surrounding walls 49*a*, 49*b* projecting downward. The surrounding walls 49*a*, 49*b* are contacted with each other at a contacting face 18*c* to form a plate-like portion opening downward in the lower face portion of the main block 18, 19. Right and left portions of the surrounding walls 49*a* are connected to each other at the rear toward the cylinder head.

On the undersurface of the cylinder block 18 is projected a further surrounding wall 50 concentrically with the bearing section 28 at the innerside of the surrounding wall 49*a* to form a semi-circular recess 51 opening downward between the surrounding walls 50 and 49*a*. The front end face of the surrounding wall 50 forms a part of the contacting face 18*c* and contacts with an end face of a branch part $49b_1$ of the surrounding wall 49*b* on the side of the split crankcase 19. Therefore, the recess 51 is closed at the front end. In FIG. 4, C1 is a cooling water passage and C2 is a cooling water drain passage.

Figure 5:
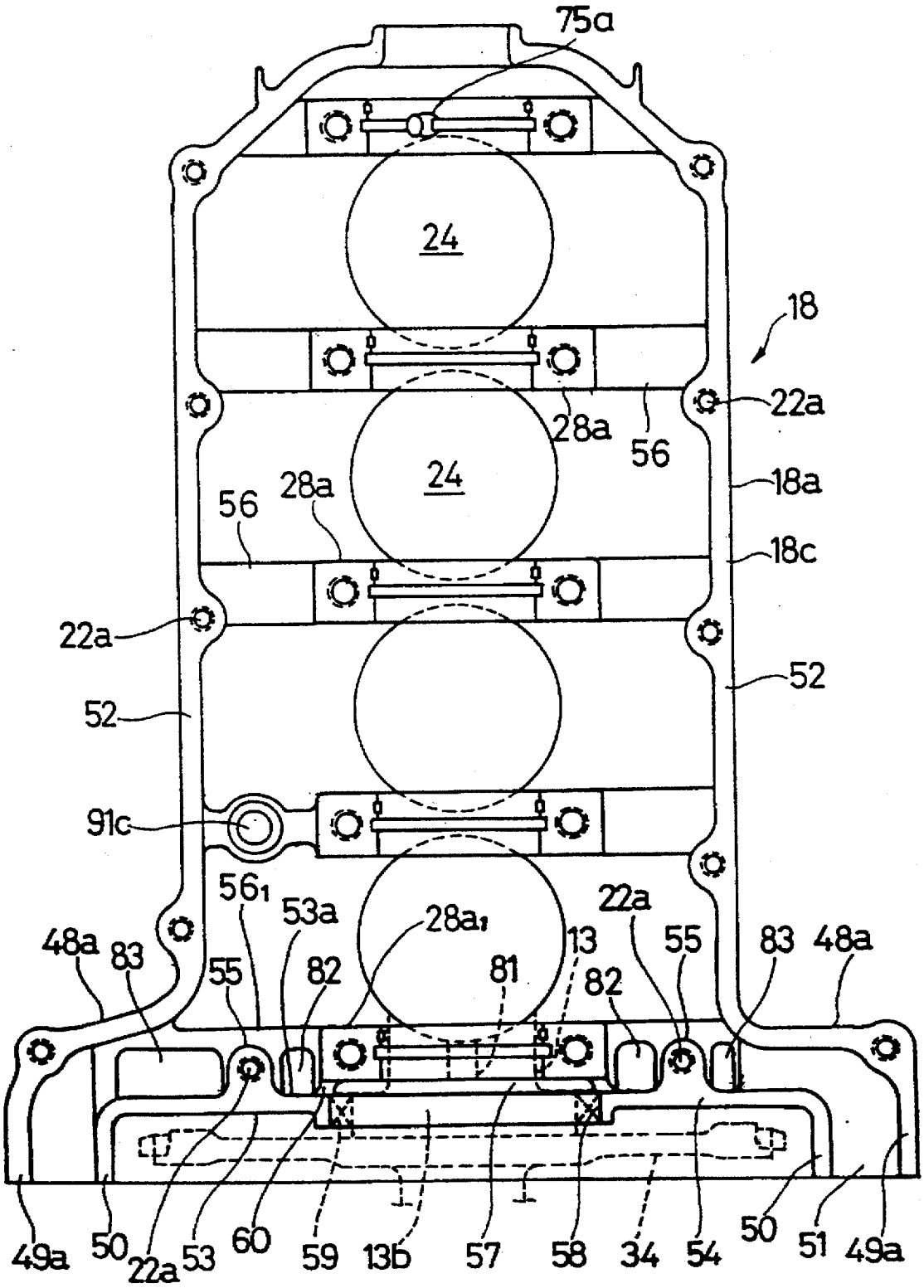
FIG. 5 is an end view showing the split crankcase side end portion of the cylinder block.

FIG. 5 is an end view showing an end face of the cylinder block 18 facing to the split crankcase 19. The end face has a packing face extending over the skirt section 18*a* and the lower swelled part 48*a* along the outline thereof. Numeral 22*a* denotes bolt holes for the abovementioned bolts 22. An end face of a bottom wall 53 extending from the cylinder side and partitioning the lower part of the crank chamber 23 also forms a packing face 54 together with the end faces of the surrounding wall 50 on the both sides. Right and left boss parts 55 are projected on the upper surface of the bottom wall 53 and extend rearward to the cylinder portion side. The end faces of the boss parts 55 form a part of the packing face 54. These boss parts 55 also have bolt holes 22*a* as mentioned above.

Also on the split crankcase 19 side are provided packing faces similar to the abovementioned packing faces 52 and 54 and the cylinder block 18 and split crankcase 19 are connected integrally with these packing faces abutted and the bolts inserted into the bolt holes to form the crank chamber 23. Namely, the abovementioned contacting face 18*c* is formed by the backing faces 52 and 53.

The crank-bearing sections 28*a* are formed on, and supported by, bearing walls 56 projecting from the inner wall surface of the skirt section 18*a* and arranged in the skirt section 18*a*. The end faces of the bearing sections 28*a* are substantially coplanar with packing face 52 but the end faces of the bearing walls 56 are slightly displaced rearward, to the cylinder side, compared to the packing face 52.

A bearing wall $56_1$ for a bearing section $28a_1$ at the lowermost position is formed on the bottom wall 53 integrally, but a lower face of the bearing section $28a_1$ is positioned above an upper face of the bottom wall 53 to form a space 57 between the bearing section $28a_1$ and the bottom wall 53. The corresponding portion of the bottom wall 53 is provided with a relatively large semi-circular hole 58 in which an enlarged lower end portion 13*b* of the crankshaft 13 passing through the bearing section $28a_1$ is fitted through a seal member 59. Since the space 57 is intercepted oil-tightly from the underside of the bottom wall 53 by the crankshaft lower end portion 13*b* and the seal member 53 and the peripheral portion of the bearing section $28a_1$ is connected to the bottom wall 53, when the split crankcase 19 of the similar construction is attached to the skirt section 18*a* putting the crankshaft 13 therebetween, the space 57 forms a closed space isolated tightly from the circumference. However, a communicating passage 60 which communicates the space 57 with outer and upper surface of the bottom wall 53 is formed each at the right and left sides by forming a slight recess on the end face (the contacting face for the split crankcase 19) at a connecting portion between the peripheral portion of the bearing section 28$a_1$ and the bottom wall 53. The bearing walls 56, 56$_1$ continue to reinforcing walls at laterals of the cylinders.

At the crankshaft lower end portion 13*b* below the bottom wall 53 is attached the flywheel 34, as described above. The flywheel 34 is housed within a substantially circular, downwardly opened recess which is covered by the bottom wall 53 and an upper wall of the swelled part 48*b* on the split crankcase 19 side from above (FIG. 2) and surrounded by the surrounding wall 50 and the surrounding wall 49*b* continuing to the wall 50 circumferentially. The recess forms an upper portion of a flywheel compartment 61 (FIG. 2) for housing the flywheel 34. That is, the lower face of the bottom wall 53 corresponds to a ceiling of the flywheel compartment 61.

Figure 6:
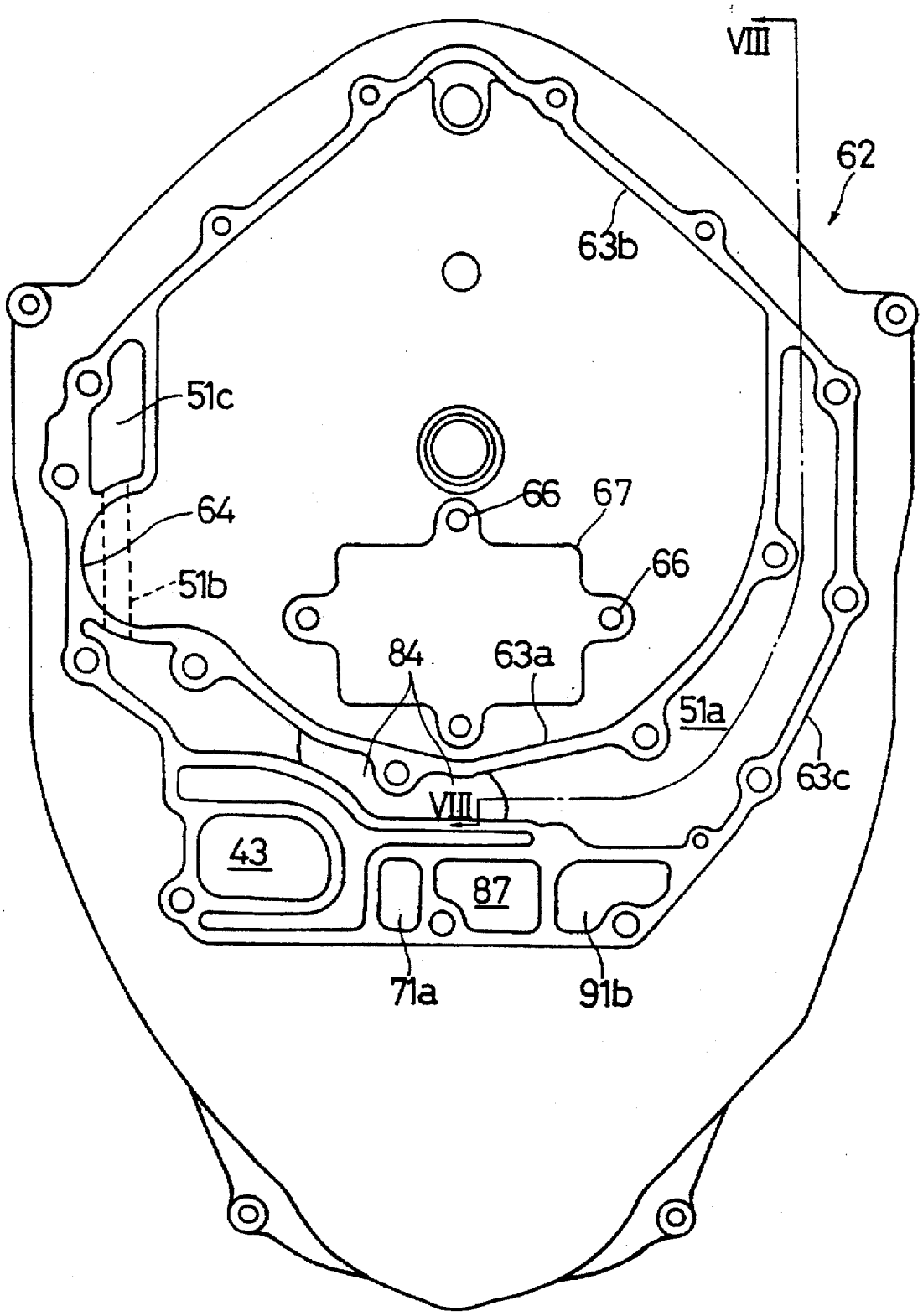
FIG. 6 is an upper view of the mount case.

As shown in FIG. 2, to a flat undersurface of the main block 18, 19 formed by a surface joining the lower end surfaces of the surrounding walls 49*a*, 49*b*, 50 is attached by bolts a mount case 62 through which the engine main body is mounted on the extension case 2. As shown in FIG. 6, on the upper surface of the mount case 62 are projected a surrounding wall 63*a* abutting against the surrounding wall 50 and a surrounding wall 63*b* abutting against the surrounding wall 49*b* in a shape of continuous loop. The portion surrounded by the surrounding walls 63*a*, 63*b* closes the recess of the main block side housing the flywheel 34 from the bottom to form the flywheel compartment 61.

Figure 7:
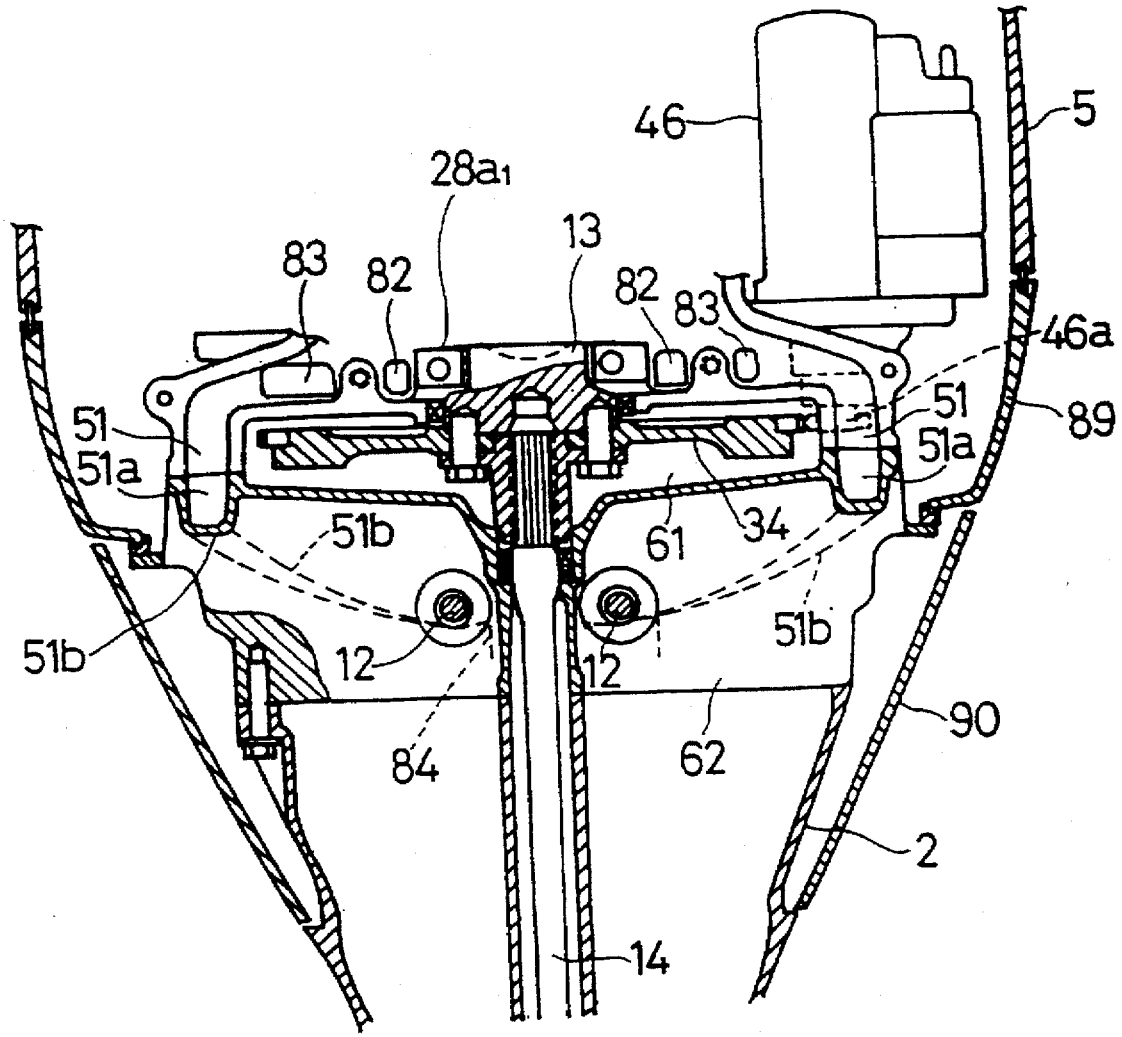
FIG. 7 is a sectional view of the mount case connected to the cylinder block cut-off along the end face of the cylinder block.
Figure 8:
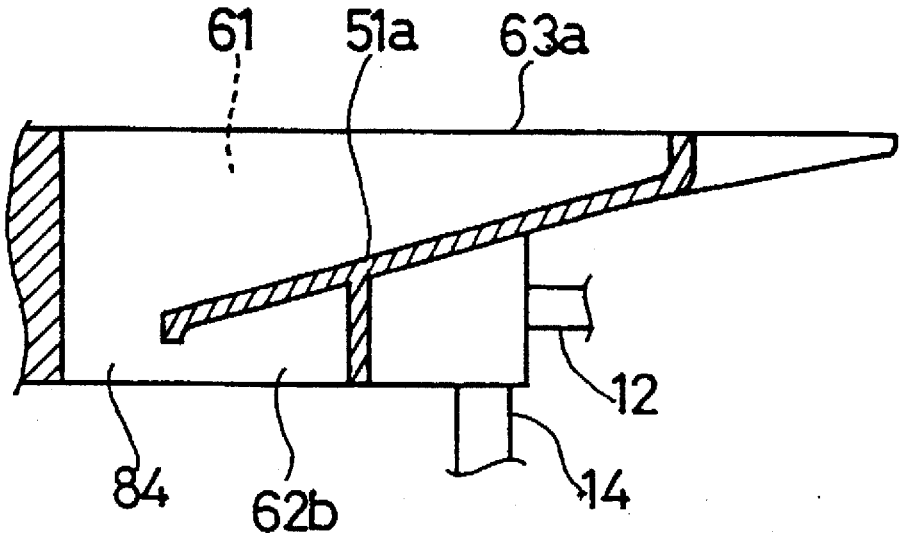
FIG. 8 is a partial sectional view taken along the line VIII—VIII of FIG. 6.

Further, a surrounding wall 63*c* abutting against the surrounding wall 49*a* is projected and a recess 51*a* joining with the recess 51 and closing the recess 51 from the bottom is formed between the surrounding walls 63*a* and 63*c* (FIG. 7).

At one side of the surrounding walls 50, 63*a* is provided a recess 64, as shown in FIG. 4, for housing the output shaft 46*a* of the starter motor 46 which projects into the flywheel room 61 and engages with the ring gear 47 of the flywheel 34. In FIG. 6, 51*b* denotes a communication part connecting a front recess portion 51*c* interrupted from the recess 51*a* by the recess 64 to the recess 51*a* at underneath of bottom wall portion of the recess 64.

The mount case 62 is connected to a pair of the right and left connecting members 12 through a mount rubber 65 extending in right and left direction. The mount rubber 65 is composed of a core member 65*a* and a rubber 65*b* surrounding it, and the connecting members 12 are connected to the core member by bolts. The rubber 65*b* is pressed from above by a pressing member 67 fastened to a bottom wall portion of the flywheel room 61 by bolts 66.

The mount case 62 has a flat lower surface at a position under the portion constituting the flywheel compartment 61 and in the rear of the driving shaft 14. An oil pan 68 is attached to the flat lower surface and hangs down in the extension case 2. The interior of the mount case 62 is divided into a portion 62*a* constituting the flywheel compartment 61 and a portion 62*b* communicating with the oil pan 68. The flywheel compartment 61 communicates with the atmosphere through a breathing pipe 61*a*.

An oil suction pipe 70 having a strainer 69 at the lower end extends upward through an oil suction passage 71*a* in the mount case 62 from a bottom portion of the oil pan 68 and connects to an oil passage 71 formed in a lower portion of the cylinder block 18. The oil suction passage 71 communicates with a suction port 73 of a pump 72 which is installed on the lower end of the cam shaft 30 and driven by the cam shaft 30. The oil suction pipe 70 may be connected to the oil suction passage 71 of the cylinder block 18 through the oil pan communicating portion 62*b* and an undermentioned oil return opening 84.

Oil compressed by the oil pump 72 is sent from a pump outlet 72*a* to a bottomed relay section 91*b* (FIG. 6) of the mount case 62 through an oil supply path 91*a* positioned lower than the lowermost cylinder, as shown in FIGS. 1 and 3. This is same as the lubricating route of the customary vertical engine. The oil supply path 91*a* rises upward at the relay section 91*b* and communicates with an oil supply path 91*c* extending horizontally at a level higher than the lowermost cylinder by one cylinder. The oil is sent through the oil supply path 91*c* to an oil filter 74 which is attached to the front face of the split crankcase 19 at a position above the contacting face 5*a* (FIG. 1) between the engine cover and the under case. Owing to such an arrangement of oil supply paths, even if there are the flywheel and the flywheel compartment below the crank chamber and the oil return passage on the bottom wall of the crank chamber, the oil can be sent from the cylinder head side to the crank chamber side without being obstructed by the flywheel, the oil return passage etc., and also detaching and changing of the oil filter can be carried out easily.

The oil flowing out from the oil filter 74 flows into an oil passage 75 arranged vertically at a widthwise central portion on the front surface of the split crankcase 19, and then reaches bearing sections 28 for the crankshaft 13 through oil paths 76 to lubricate the bearings. Further, the oil reaches crankpin bearings 78 and interiors of the cylinders 24 through oil paths 77 drilled in the crankshaft 13 to lubricate the crankpin bearings and inner surfaces of the cylinders. In addition, the oil is sent toward the cylinder head 20 from an upper part of the oil path 75 through the crankshaft 13 and an upper portion of the cylinder block 18 to lubricate the cam shaft 30.

The oil reaching the cylinder 24 is scraped off into the crank chamber 23 as well as spreading over the inner surface of the cylinder by the sliding motion of the piston 25. However, since the thickness of the cylinder wall portion 79 partitioning upper and lower cylinders 24 is thinner than the thickness (width) of the bearing section 28*a* connecting to the wall portion 79, there is formed a step part a and the oil is apt to remain on the step part a. Therefore, an oil hole 80 communicating with the upper and lower cylinders 24, 24 is drilled in the step part to drop the remaining oil into the lower cylinder.

The oil hole 80 can be drilled easily without interfering with other parts, by directing a tool such as a drill toward the skirt section 18*a* of the cylinder block 18 from the opened side thereof having the contacting face for the split crankcase 19 obliquely upward. Therefore, the oil hole 80 is formed directed obliquely upward from the lower surface side of the cylinder wall portion 79.

Similar oil holes 80 are provided between each set of adjacent cylinders in the underneath and the oil in each cylinder 24 flows down in sequence through the oil holes 80 and reaches the lowermost cylinder 24. The lowermost cylinder 24 is provided with an oil dropping hole 81 similar to the oil hole 80. The oil dropping hole 81 is drilled in the bearing wall 56$_1$ for the bearing section 28$a_1$ in a plane including the cylinder axis (FIG. 5) and opens in the space 57. The oil dropping hole 81 can be drilled without making a hole in the packing face 54 by directing a tool obliquely from the side of the contacting face for the split crankcase 19.

Since the underneath of the space 57 is closed by the enlarged lower end portion 13*b* of the crankshaft 13 and seal member 59, the oil flowing down into the space 57 through the oil dropping hole 81 flows out on the adjacent upper surface portion 53*a* of the bottom wall 53 through the right and left communicating passages 60 without flowing into the flywheel compartment 61 housing the flywheel 34 in the underneath. The oil flowing directly on the oil seal 59 from the lowermost bearing section 28*a* is returned through the space 57 in the same manner.

In order to guide the oil flowing out on the adjacent upper surface portion 53*a*, the outside of which is interrupted by the boss section 55, an oil return passage 82 penetrating the bearing wall 56 and extending rearward; namely, toward the cylinder head side, is provided. The oil return passage 82 reaches a position above the surrounding wall 50, as shown in FIG. 4. Accordingly, the oil passing through the oil return passage 82 flows into the recess 51 formed outside the surrounding wall 50 and drops into the recess 51*a* of the mount case 62 receiving the recess 51 from the under side.

Also at the outside of the boss section 55 is provided a similar oil return passage 83 penetrating the bearing wall $56_1$ to drop the return oil collected on the outside of the bottom wall 53 into the recess 51*a* through the oil return passage 83.

In such a way, an oil return passage surrounding the outside of the flywheel compartment 61 in a shape of a half loop from the vicinity of the contacting faces between the cylinder block 18 and the split crankcase 19 toward the rear is formed. The bottom wall of the oil return passage; namely, the bottom wall 51*b* of the recess 51*a*, is inclined downward toward the rear as shown in FIGS. 2 and 7, and at the lowest rearwardmost part of the passage is provided an oil return opening 84 (FIG. 6) which opens to the oil pan communicating portion 62*b* of the mount case 62. Accordingly, the oil dropping into the recess 51*a* through the oil return passages 82, 83 flows on the bottom wall 51*b* toward the oil return opening 84 side, drops from the oil return opening 84 through the oil pan communicating portion 62*b* and returns into the oil pan 68 therebelow.

In other words, laterally of the flywheel 34 is formed an oil return passage communicating with the crank chamber 23 and the oil pan 68. The oil return passage is constituted by a vertical first passage portion and a second passage portion. The first passage portion is formed by a portion within the oil pan communicating portion 62*b* in which the oil drops from an oil return opening 84 onto the oil pan (the portion shown by the dotted line 84*a* in FIG. 2), positioned below the flywheel 34 and communicates with the oil pan 68. The second passage portion is formed by the recesses 51, 51*a* and extends along the outer peripheral part of the flywheel 34 toward the first passage portion 48*a* inclining downward. And this oil return passage is formed on a housing portion covering the flywheel 34 by the surrounding walls 49, 50, 63 etc.

In such a manner, an oil return passage skillfully detouring around the flywheel space 61 under the crank chamber 23 is formed between the crank chamber 23 and the oil pan 68 without enlarging the engine. Since the outlet of the oil return passage; namely, the oil return opening 84, is positioned at a sufficiently lower position than the bottom part of the crank chamber 23 owing to the inclination of the bottom wall 51*b*, even if the crank chamber 23 side becomes lower than the valve gear chamber 29 side because of pitching of the outboard motor 1, for example, the oil in the crank chamber 23 can be returned into the oil pan 68 without any trouble.

The oil having lubricated around the cam shaft 30 reaches an oil return opening 86 through an oil passage 85 and returns into the oil pan 68 through an oil return passage 87 and an oil return pipe 88.

What is claimed is:

1. A vertical engine having a crankshaft directed in a vertical direction and a flywheel provided on a lower end of the crankshaft projected through a bottom wall of a crank chamber comprising:

a flywheel compartment formed under said bottom wall of the crank chamber for housing said flywheel;

an oil pan provided under said flywheel compartment and containing oil for lubricating said crankshaft, at least a part of said oil pan being positioned at a side opposite to said crank chamber with respect to said flywheel compartment;

an oil return passage for returning said oil from said crank chamber to said oil pan detouring around said flywheel compartment, wherein said oil return passage is formed in a housing covering said flywheel and includes a first vertical passage portion positioned lower than said flywheel and communicating with said oil pan and a second passage portion extending along an outer peripheral part of said flywheel compartment and inclined downward toward said first passage portion.

2. A vertical engine having a crankshaft directed in a vertical direction and a flywheel provided on a lower end of the crankshaft projected through a bottom wall of a crank chamber comprising:

a flywheel compartment formed under said bottom wall of the crank chamber for housing said flywheel;

an oil pan provided under said flywheel compartment and containing oil for lubricating said crankshaft, at least a part of said oil pan being positioned at a side opposite to said crank chamber with respect to said flywheel compartment;

an oil return passage for returning said oil from said crank chamber to said oil pan detouring around said flywheel compartment;

a skirt section provided integrally with a cylinder block;

a split crankcase attached to said skirt section putting respective contacting faces together to form said crank chamber;

a bearing wall section provided on said cylinder block side and forming a lowest crank bearing section within said crank chamber; and an oil dropping hole provided in said bearing wall section and communicating with a lower side of said bearing wall section and an upper side of said bearing wall section positioned within a lowest cylinder, said oil dropping hole being inclined downward from said cylinder side to said contacting face of said skirt section facing to said split crankcase.

3. A vertical engine as claimed in claim 2, wherein said engine is an in-line multi-cylinder engine having a plurality of cylinders arranged vertically in said cylinder block, oil holes are provided in cylinder wall portions partitioning neighboring upper and lower cylinders at ends of said crank chamber side respectively and each of said oil holes extends obliquely upward from said contacting face of said skirt section facing to said split crankcase.

4. A vertical engine as claimed in claim 2, wherein a crank chamber bottom wall portion spreading under said bearing wall section covering said flywheel from above is provided and an oil passage guiding oil from said oil dropping hole to a cylinder head side is provided in said crank chamber bottom wall portion.

5. A vertical engine comprising:

a crank chamber;

a crankshaft enclosed by said crank chamber, said crankshaft having a vertically directed axis of rotation and a lower end projecting from a bottom wall of said crank chamber;

a flywheel disposed externally of the bottom wall of said crank chamber and coaxially connected to said crankshaft lower end;

a flywheel compartment formed under said crank chamber bottom wall and housing said flywheel, a drive shaft having a vertically disposed axis coaxially connected to said flywheel and extending from said flywheel compartment;

an oil pan containing oil for lubricating said crankshaft disposed beneath, and separate from, said crank chamber and said flywheel compartment, and being laterally displaced from said drive shaft; and an oil return passage for returning oil from said crank chamber to said oil pan extending around said flywheel compartment.

6. A vertical engine as claimed in claim 5 in which said crank chamber contains a cylinder head side laterally displaced from said crankshaft and wherein said oil return passage extends from said cylinder head side of said crank chamber and includes an opening through said crank chamber bottom wall to extend to a position laterally spaced from the outer periphery of said flywheel compartment.

7. A vertical engine as claimed in claim 6, wherein said crank chamber is formed by a skirt section integral with a cylinder block and a split crankcase attached to said skirt section having respective contacting faces thereof in mutual abutment, right and left boss sections projecting from a wall portion of the crank chamber at which said faces of said skirt section and said split crankcase abut each other, bolt holes for connecting said skirt section and said split crankcase provided in said boss sections, and said oil return passage communicating at least between said right and left boss sections.

8. A vertical engine as claimed in claim 5, wherein said oil return passage includes a first vertical passage portion positioned lower than said flywheel and communicating with said oil pan and a second passage portion extending along an outer peripheral part of said flywheel compartment and inclined downward toward said first passage portion.

* * * * *